United States Patent [19]

Martin et al.

[11] Patent Number: 4,855,209

[45] Date of Patent: Aug. 8, 1989

[54] LOW MELTING ENCAPSULATED TONERS

[75] Inventors: Trevor I. Martin, Burlington; Marcel P. Breton, Mississauga; Randolph E. Branston, Sarnia; Karen A. Moffat, Brantford; Walter Mychajlowskij, Georgetown, all of Canada

[73] Assignee: Xerox Corporation, Stamford, Conn.

[21] Appl. No.: 128,851

[22] Filed: Dec. 4, 1987

[51] Int. Cl.[4] ..... G03G 13/14

[52] U.S. Cl. ..... 430/126; 430/138

[58] Field of Search ..... 430/137, 138, 109, 111, 430/110, 126

[56] References Cited

U.S. PATENT DOCUMENTS

| | | | |
|---|---|---|---|
| 4,500,624 | 2/1985 | Aono et al. | 430/138 |
| 4,529,681 | 7/1985 | Usami et al. | 430/138 |
| 4,533,617 | 8/1985 | Inoue et al. | 430/111 |
| 4,536,462 | 8/1985 | Mehl | 430/106 |
| 4,562,137 | 12/1985 | Sanders | 430/138 |
| 4,708,924 | 11/1987 | Nagai et al. | 430/138 |
| 4,717,638 | 1/1988 | Mikami et al. | 430/138 |

FOREIGN PATENT DOCUMENTS

| | | |
|---|---|---|
| 53-119044 | 10/1978 | Japan . |
| 2112538 | 7/1983 | United Kingdom . |

*Primary Examiner*—John L. Goodrow

*Attorney, Agent, or Firm*—E. O. Palazzo

[57] ABSTRACT

An encapsulated toner composition with a melting temperature of from about 65° C. to about 140° C. comprised of a core containing a polymer selected from the group consisting of polyethylene succinate, polyhalogenated olefins, poly(alpha-alkylstyrenes), rosin modified maleic resins, aliphatic hydrocarbon resins, poly(ε-caprolactones), and mixtures thereof; and pigment particles, where the core is encapsulated in a shell prepared by interfacial polymerization reactions.

31 Claims, No Drawings

LOW MELTING ENCAPSULATED TONERS

BACKGROUND OF THE INVENTION

This invention relates generally to toner compositions, and more specifically to encapsulated toner compositions with certain characteristics. Accordingly, in one embodiment of the present invention there are provided encapsulated toner compositions with low melting characteristics comprised of a polymeric core with pigment particles therein and a shell prepared, for example, by interfacial polymerization processes. Moreover, the encapsulated toner compositions of the present invention can contain in the core other additives inclusive of silicone oils and waxes enabling the resulting toners to be useful for incorporation into electrophotographic imaging apparatuses wherein the costly devices needed for the retaining and release of silicone oils is avoided. Specifically, therefore, the toner compositions of the present invention possess low melting properties, that is for example they melt at temperatures between 65° C. and 140° C.; enable superior optical densities for the images developed; and in addition, the toner compositions of the present invention especially wherein the core contains therein release fluids such as silicone oils are useful in electrophotographic imaging devices. Therefore, the toner compositions of the present invention are useful in electrophotographic, particularly xerographic imaging and printing processes inclusive of those processes wherein there is avoided the need for costly release fluid systems. The toner compositions of the present invention also enable the formation of images which have low gloss properties because of the lower pressures and lower temperature required for their fusing on paper. This lower gloss can also be attributed to the presence of a high glass transition temperature shell (greater than 60° C.), which results upon fusing of the toner in uneven surfaces as the shell rheological properties are different than those of the core polymers. In addition, the present invention is directed to processes for the preparation of toner compositions, which processes in one embodiment utilizes a solvent system enabling the resulting toner to possess a density of from about 0.2 to about 0.8 gram per cubic centimeter with higher densities being achievable by selecting insitu free radical polymerization of the core components.

Encapsulated cold pressure fixable toners with improved imaging and fusing properties are disclosed in copending application U.S. Pat. No. 4,727,011, entitled Processes For Encapsulated Toner Compositions With Interfacial/Free-Radical Polymerization, the disclosure of which is totally incorporated herein by reference. These toner compositions, however, are not effective in some situations wherein there is desired carbon black based heat fusible encapsulated toners with desirable size polydispersity, and also such toners cannot usually be prepared at low cost, disadvantages alleviated with the toner compositions and processes of the present invention. For example, the toner compositions of the present invention can be prepared by a solvent based process allowing flexibility with respect to the type of materials which can be used in the core of the encapsulated toner, or a monomer based process enabling lower cost by eliminating solvent recovery. More specifically, with the process of the present invention there can be prepared carbon black based encapsulated toners by an insitu free radical polymerization process, and wherein the core of the toners can be formulated from a blend of polymers and insitu polymerized monomers thereby significantly effecting the toner fusing temperature. Thus, because of the inherent compatibility of the pigment such as carbon black with polymers, the carbon black or other pigment can be trapped in high proportion in the toner core with the process of the present invention. Another advantage achievable with the toner compositions and processes of the present invention resides in the selection of free radical polymerization of vinyl monomers and the presence of pigment particles such as carbon black, which advantage is achievable, for example, by selecting low surface area carbon black particles with neutral pHs in combination with azo initiators, which minimize the inhibition effects usually associated with higher surface area carbon blacks or, for example, by ball milling the pigment particles such as carbon black in the presence of monomer and initiator in the presence or absence of heat.

Encapsulated toner compositions, inclusive of cold pressure fixable toner compositions, are known as indicated herein. Also known are toner compositions that are heat fusible in electrophotographic imaging processes, these toner compositions generally not being encapsulated. In U.S. Pat. No. 4,533,617 there is, however, described a heat fixable developer containing a capsule structure having the surface of a core particle coated with a vinyl type polymer with a glass transition temperature of 55° C. or higher, a softening point of 100° to 150° C., a molecular weight of 150,000 or more, and a $M_w/M_n$ of 5 or more. As indicated in column 3, beginning at line 49, of this patent there is provided a heat fixing developer of a capsule structure containing in the core a binder resin with a glass transition temperature of 60° C. or lower, a softening point of 50° to 130° C., and a colorant. Also, it is stated in column 3, beginning at line 58, that the binder resin contains an amorphous polyester or a vinyl type polymer having a crosslinked structure with a gel content of 20 percent or more as the main component. In comparison, the toner composition of the present invention, for example, does not contain a crosslinked component with a gel content of 20 percent or more as the main component of the core.

In addition, there is illustrated in U.S. Pat. No. 4,562,137 that a microcapsule rupture can be affected by pressure or other means including ultrasonic vibration, solvent vapor means, and other methods, reference column 6; and morever, in column 8, interfacial polymerization processes are illustrated. The toner composition of the present invention, while prepared by known interfacial polymerization as an encapsulation method, do not contain thereon radiation sensitive compositions such as those described in the '137 patent. In addition, of background interest there are mentioned as representative patents U.S. Pat. Nos. 4,529,681; 4,536,462 and British Patent Publication No. 2,112,538. While the subject matter of these patents is of interest, none of them teach a low melting encapsulated toner containing the components of the present invention, and in particular a core comprised of certain polymers with additives inclusive of pigment particles therein. Moreover, Japanese Patent Publication abstract No. 53-119044 illustrates an encapsulated toner wherein the marking materials are released by sublimation of the capsule under heat.

With further reference to the prior art, there are disclosed in U.S. Pat. No. 4,307,169 microcapsular electrostatic marking particles containing a pressure fixable core, and an encapsulating substance comprised of a pressure rupturable shell wherein the shell, such as a polyamide, is formed by an interfacial polymerization. Furthermore, there are disclosed in U.S. Pat. No. 4,407,922 pressure sensitive toner compositions obtained by interfacial polymerization processes, and comprised of a blend of two immiscible polymers selected from the group consisting of certain polymers as a hard component, and polyoctyldecylvinylether-co-maleic anhydride as a soft component.

With further reference to the prior art, there is disclosed in U.S. Pat. No. 4,476,211 the preparation of electrostatographic toner materials with surface electroconductivity. Specifically, there is disclosed in the '211 patent a cold pressure fixable toner composition with polyamide, polyurea, and other types of shell materials prepared by an interfacial polymerization process. The colorant selected for these compositions is generally comprised of a variety of dyes or pigments, and the core contains a polymeric material with a binder therein for retaining the colorant within the core and assisting in the fixing of the the colorant onto the surface of a support medium. Examples of high boiling liquids selected for the process of the '211 patent include those boiling at temperatures higher than 180° C. such as phthalic esters, phosphoric acid esters, and alkyl naphthalenes.

Moreover, illustrated in a copending application U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676 relating to cold pressure fixable toners, the disclosure of which is totally incorporated herein by reference. In the aforementioned application, the core can be comprised of magnetite and a polyisobutylene of a specific molecular weight encapsulated in a polymeric shell material generated by an interfacial polymerization process. Also illustrated in a copending application U.S. Ser. No. 043,265, the disclosure of which is totally incorporated herein by reference, are heat fusible toner compositions comprised of a polymeric core component, and thereover a thermotropic liquid crystalline polymeric shell. By contrast, the toner compositions of the present invention do not contain thermotropic liquid crystalline shells. Low melting characteristics for the compositions of the present invention are rendered possible by the use of multi-component core compositions with components having a sharp melting point as low as 50° C., and by the selection of a lower proportion of shell materials, all other factors being the same.

There thus remains a need for encapsulated toner compositions that possess the improved characteristics illustrated herein. There also is a need for encapsulated toners wherein the shell is ruptured upon heating at low pressures. Further, there is a need for encapsulated toner compositions that will enable images of high optical densities. Also, there is a need for encapsulated toner compositions which can be utilized in electrophotographic imaging apparatuses without release fluid devices. Moreover, there remains a need for low melt toner compositions containing polymers with a softening point between about 50° and 120° C. as the core, and a capsule thereof formulated by interfacial polymerization process. Another need resides in encapsulated low melting toners thereby enabling a significant reduction in the amount of energy required for accomplishing heat fusing of images formulated in electrophotographic apparatuses. There also remains a need for low gloss images after the toner composition is fused to the substrate. Additionally, there is a need for a process allowing the formation of low density toner materials under controlled conditions, and which processes will result in lower cost per copy. There is also a need for encapsulated toners containing both magnetite and carbon black, enabling the control of toner dust in electrophotographic apparatuses. Further, there is also a need for low melt encapsulated toners with acceptable mechanical properties, that is a toner which does not break upon handling in the toner sump or during packaging or storage.

SUMMARY OF THE INVENTION

It is an object of the present invention to provide encapsulated toner compositions with many of the above advantages.

Another object of the present invention resides in the provision of low melting encapsulated toner compositions.

In addition, a further object of the present invention resides in encapsulated toner compositions that enable images with improved optical densities.

Additionally, another object of the present invention is directed to a low melt toner composition which enables significant reduction in the energy requirements needed for fusing the images formulated in electrophotographic imaging apparatuses.

Further, in still another object of the present invention there are provided toner compositions containing specific core components encapsulated within a shell formulated by an interfacial polymerization process.

Another object of the present invention is directed to encapsulated toner compositions having incorporated in the core components release fluids enabling these compositions to be useful in electrophotographic imaging apparatuses while simultaneously avoiding the need for release management systems devices.

Another object of the present invention is directed to encapsulated toner compositions having incorporated in the core components such as magnetite enabling these compositions to be useful in electrophotographic imaging apparatuses while simultaneously avoiding the build-up of toner dust in these apparatuses, the dust being removed magnetically.

Also, in another object of the present invention there are provided encapsulated toner compositions that are useful in electrophotographic imaging and printing processes.

Also, there is a need for processes that permit the forming of encapsulated toners, which processes enable high free radical polymerization conversion within the core of the encapsulated toner and in the presence of pigments such as carbon black.

These and other objects of the present invention are accomplished by the provision of improved encapsulated toners. More specifically, the present invention is directed to encapsulated toners with low melting characteristics comprised of a core component surrounded with a shell formulated by interfacial polymerization process. Accordingly, in one specific embodiment of the present invention there is provided a low melting encapsulated toner comprised of certain polymeric cores, pigment particles, and optional additive particles surrounded by a shell formulated by an interfacial polymerization process. In one specific embodiment of the present invention, there is thus provided an encapsulated toner composition comprised of a core containing a polymer selected from the group consisting of polyethylene succinate, polyhalogenated olefins, poly(alpha-alkylstyrenes), rosin modified maleic resins, aliphatic hydrocarbon resins, and poly(⊖-caprolactones); and pigment particles, wherein the core is encapsulated within a shell prepared by interfacial polymerization reactions. Moreover, in another embodiment of the present invention the core can comprise mixtures of the aforementioned polymers, or the aforementioned polymers admixed with vinyl monomers, particularly those prepared by insitu polymerization processes.

Specifically, in one embodiment of the present invention, there is provided a toner composition with a glass transition temperature of from about −50° C. to about 50° C. for the core polymer containing pigment particles and optional additive particles; and a glass transition temperature greater than 55° C. for the surrounding shell prepared by interfacial polymerization. Another embodiment of the present invention is directed to a low melting toner composition comprised of a core containing a polymeric component selected from the group consisting of polyethylene succinate, polychlorinated olefins, poly(alphamethylstyrene), rosin modified maleic resins available from the Union CAMP Corporation, low melting hydrocarbon resins, and poly(ϵ-caprolactones); pigment particles selected from the group consisting of carbon black, magnetites, or mixtures thereof; and surrounding the core a polymeric shell formulated by interfacial polymerization and selected from the group consisting of polyureas, polyurethanes, polyamides, polyesteramides, and/or combinations thereof.

By low melt characteristics in accordance with the present invention is meant, for example, toners that can fuse at temperatures as low as 120° C., fuser setting, and under 400 psi pressure. Thus, the toners of the present invention possess a melting temperature of from about 65° C. to about 140° C. Improved optical densities refers to the production of images with optical densities of from about 1.2 to about 1.7 with substantially no background deposits.

Illustrative examples of polymers selected for the core of the encapsulated toner of the present invention include polyalkylene succinates such as polymethylene succinate, polyethylene succinate, polypropylene succinate; polyhalogenated olefins inclusive of polychlorinated olefins such as Eastman Chemicals CP-153-2, CP-343-1, CP-343-3 and CP-515-2 in which the weight precent can vary from about 20 to about 30 percent by weight, and mixtures thereof; Elvax resins, available from E.I. DuPont, of low molecular weight and which are soluble in organic mediums; and poly(alpha-alkylstyrenes), especially the methyl styrene of melting point ranging from about 80 to about 115° C., and preferably with molecular weight between 600 and 1,000. Other polymers or additives which can be selected for the core are Ultraflex wax of melting point of about 60° C. (Petrolite), plasticizers such as those commercially available as Kodaflex (Eastman Kodak), Unirez resin (Union Camp Corporation) of softening point ranging from about 95° to 150° C., and Eastman Eastotac TM resins of softening point of about 100° C. The polymer resins are present in the toner of the present invention in an amount of from about 50 to about 85 precent by weight, and preferably from about 65 to about 80 percent by weight.

Examples of useful pigments in addition to carbon black selected for the encapsulated toner compositions of the present invention and present in various effective amounts of, for example, from 1 to about 20 percent by weight include magnetites such as those commercially available from Mobay, Pfizer, and BASF. With further respect to the present invention, and to achieve, for example, improved optical densities there are selected specific carbon blacks such as Regal® 330, Carbon Black 5250, and Carbon Black 5750 (Columbian Chemicals Company), in the presence or not of additives such as nigrosine. In one preferred embodiment, as mixtures there is selected about 2 to about 10 percent of carbon black, from about 10 to about 40 percent by weight of magnetite.

Examples of pigment dispersants that can be selected for the encapsulated toner compositions of the present invention and that are present in various amounts of, for example, from about 0.1 percent to about 2.0 percent by weight of solvent or monomer used, and preferably from 0.5 to 1.5 percent by weight, include Ganex V216 and V220 (GAF), OLOA 1200 (Chevron), Pliolite OMS (Goodyear), and Shelflex 310 (Shell Chemicals).

Moreover, optional additives can be incorporated into the toner composition core of the present invention inclusive of release fluid components. Accordingly, for example, there can be incorporated into the core components in an amount of from about 1 percent by weight to about 10 percent by weight release components such as silicone oils, inclusive of those available from Dow Corning (Spectrum 1 type, high viscosity), and for which suitable diluents include aromatic and chlorinated hydrocarbons; mineral oils, organosulfo derivatives, waxes and the like. Specific examples of waxes include candelilla, bees wax, sugar cane wax, carnuba wax and other similar waxes, particularly those with a melting point of about 60° C.

As shell components present in an amount of from about 5 to 50 percent by weight, there can be selected aromatic polyureas, polyurethanes, polyesters, polyamides, polyesteramides, and combinations thereof; and the like. These shells are prepared by interfacial polymerization processes as illustrated, for example, in U.S. Pat. Nos. 4,000,087; 4,307,169 and 3,492,827, the disclosures of which are totally incorporated herein by reference. In one interfacial polymerization process applicable to the present invention, there is emulsified in an aqueous phase containing a dispersant a nonaqueous phase containing di-and tri-functional reacting materials, such as sebacoyl chloride or other aliphatic or aromatic acid chlorides. Under high shear conditions, microdroplets of the organic phase are formed. Upon addition of a co-reacting material such as diethylenetriamine or hexanediamine in the water phase, a shell is formed at the aqueous/nonaqueous interface to yield an encapsulated material.

Positively or negatively charged toners can be achievable in accordance with the present invention by, for example, modifying the selection of the shell components. Thus, for example, positively charged toners are provided when there are selected polyurea or polyamide shells with no pendant functional groups thereon, while polyamide shells derived from 4,4'-diamino-2,2'-biphenyl disulfonic acid, 4,4'-diamino-2,2'-stylbenedisulfonic acid, 2,5-diamino benzene sulfonic acid, and the like enable negatively charged toners. Moreover, there can be incorporated into the toner compositions of the present invention, particularly the core charge enhancing additives in an amount of from about 1 percent to about 20 percent by weight, to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like.

As external additives to the formulated encapsulated toners of the present invention, there can be added in an amount of, for example, from about 0.1 percent by weight to about 1 percent by weight colloidal silicas, inclusive of Aerosils and/or metal salts, or metal salts of fatty acids, inclusive of zinc stearate.

Other important characteristics associated with the toner composition of the present invention include a core that is composed of low melt polymers and waxes which melt at low temperature encapsulated by a shell which is weak enough to release the core upon fusing under, for example, 400 psi pressure, but strong enough to withstand mechanical handling in a toner sump. The toner composition of the present invention can also be fused at low temperatures, that is 50° C. lower than the fusing temperature of many known toners, that is about 120° C.

The heat fusible toner compositions of the present invention can be prepared by a number of suitable methods. One preferred specific illustrative method of preparation comprises (1) dispersing under vigorous agitation pigments such as carbon black in an amount of from about 3 percent to about 10 percent, and preferably from about 5 percent to about 8 percent by weight, and magnetite from about 5 to about 60 percent by weight, and preferably from about 10 to 20 percent by weight in a methylene chloride solution containing from about 0.2 to about 2 percent by weight of a pigment dispersant, and preferably from 0.2 to 1 percent by weight, and in which is also dissolved about 20 to 50 percent by weight of a core polymer such as a chlorinated polyolefin CP343.1, and preferably from 15 to 35 percent by weight; (2) ball milling the resulting pigmented core dispersion obtained in step (1) for a period of about 16 to 48 hours with ½ by volume of 5 millimeter diameter ball bearings resulting in a well dispersed pigment solution; (3) transferring the core solution into a 1 liter plastic bottle, separating the ball bearings; (4) homogenizing the mixture with a polytron for a period of 3 minutes at 10,000 rpm with a PTA-20TS probe and a Brinkman PT45/80 homogenizer; (5) adding sebacoyl chloride in an amount of from about 2 to about 15 percent by weight, preferably from about 5 to about 10 percent by weight; and homogenizing at 5,000 rpm for 30 seconds with the aforementioned probe; (6) adding the formed organic phase to an aqueous phase consisting of about 0.05 to 2.0 percent, and preferably from about 0.1 to 1.5 percent by weight of polyvinyl alcohol solution to which is added 2-decanol, 0.5 milliliter, and homogenizing it for 3 minutes at 10,000 rpm with a PTA-20TS probe, wherein the homogenization can be accomplished in a 2 liter beaker; (7) transferring the formed oil/water mixture into a 2 liter reaction kettle equipped with a mechanical stirrer and an oil bath under the reactor; (8) adding a 24 percent sodium carbonate $Na_2CO_3$ amine solution containing 3 to 15 percent, and preferably 5 to 10 percent, of a 1 to 1 mixture of 1,6 hexanediamine and diethylenetriamine; (9) after mixing 2 hours at room temperature a polyamide shell is formed between the acid chloride and amine by increasing the temperatures to 65° C. for 16 hours, and the volume of the solution to 1.5 liters with distilled water; wherein the methylene chloride partly evaporates during this mixing; (10) cooling the solution to room temperature and washing it 5 times by settling with a magnet and decanting off the surfactant; and (11) screening the resulting wet toner particles through a 425 and 250 microns sieve, and then spray drying the toner with a Yamato-Ohkawara spray dryer model DL-41 at an inlet temperature of 120° C. and an outlet temperature of 55° C. providing a specific encapsulated toner of the present invention.

The toner compositions of the present invention are useful for enabling the development of electrostatic images including color images. Examples of photoconductive members selected for the imaging apparatus are selenium, selenium alloys, selenium containing halogen materials therein, selenium alloys with halogen materials, layered photoresponsive imaging memebers such as those illustrated in U.S. Pat. No. 4,225,990, the disclosure of which is totally incorporated herein by reference; and other known photoconductive substances inclusive of squaraines, perylenes, and azo materials wherein these materials are utilized as the photogenerating pigment.

With further respect to the toner compositions of the present invention, in one embodiment they preferably contain from about 1 to about 20 percent by weight of wax, and more preferably from about 3 to about 15 percent by weight of wax; from about 3 to about 10 percent by weight of pigment, and preferably from about 4 to about 8 percent by weight of pigment, which pigment is usually carbon black; from about 1 to about 20 percent by weight of magnetite, and preferably from about 10 to about 20 percent by weight of magnetite; and from about 5 to about 50 percent by weight, and preferably from about 5 to about 30 percent by weight of a polymeric shell.

The following examples are being supplied to further define various species of the present invention. These examples are intended to be illustrative only and are not intended to limit the scope of the present invention. Also, parts and percentages are by weight unless otherwise indicated.

EXAMPLE I

A black low melt encapsulated toner was prepared as follows: Into a polyethylene bottle, 250 milliliters, was added methylene chloride ACS (Caledon), 125 milliliters, a carbon black dispersant Ganex V216 (GAF), 0.125 gram, nigrosine (Aldrich), 0.25 gram, poly(ethylene succinate) (Scientific Polymer Products), 13.25 grams and Oppanol B-10 (polyisobutylene) (BASF), 2.5 grams. This polymeric core solution was mixed overnight on a Burrell wrist action shaker model 75 to dissolve the polymers. To this was added MO-8029 magnetite (Pfizer Corp.), 4.0 grams, Sterling MT CT-9226 carbon black (Cabot), 1.0 gram, which was dispersed with a Brinkmann PT 45/80 homogenizer and a PTA-20TS probe for 1 minute at 10,000 rpm setting in a cold water bath. To the polymer pigment solution was then added sebacoyl chloride (Aldrich), 2.85 grams, which was dispersed at 5,000 rpm for 30 seconds with the PTA-20TS probe. This core polymer mixture was further dispersed with a PTA 35/4G probe into 0.75 percent of a polyvinylalcohol (Scientific Polymer Products, 88 percent hydrolyzed, molecular weight 96,000) solution, 500 milliliters, 2-decanol (Aldrich), 0.5 milliliters, and $Na_2CO_3$ (Baker), 2.62 grams, for 30 seconds at 8,000 rpm. The resulting solution was transferred into a 2 liter beaker equipped with a mechanical stirrer, and an oil bath under the beaker. While stirring the solution vigorously, an aqueous mixture of 1,6 hexanediamine (Aldrich), 0.5 gram, diethylenetriamine (Aldrich), 0.6 gram, and distilled water, 25 milliliters, was added slowly dropwise over a 1 minute period. After complete addition of the amine solution, the stirring rate was decreased and the solution was stirred for 2 hours at room temperature permitting interfacial polymerization, and enabling formation of a polyamide shell. The temperature of the solution was increased to 50° C. for 3 hours to evaporate the methylene chloride, and the solution cooled to room temperature, and washed five times with distilled water by settling with a magnet. After washing, the encapsulated toner particles, melting temperature about 110° C., were isolated by freeze drying on a Labconco freeze dryer model 12.

EXAMPLE II

A black low melt, 120° C., encapsulated toner was prepared by repeating the procedure of Example I with the exceptions that nigrosine (Aldrich), 0.25 gram, was not added, and the carbon black (Sterling MT) Cabot, 1.0 gram, and magnetite MO-8029 (Pfizer Corp.) 4.0 grams, was dispersed into the polymer solution for 2 minutes at 10,000 rpm with the PTA-20TS probe instead of 1 minute at 10,000 rpm. Also, the dispersion conditions for dispersing the organics into the water phase was changed to 30 seconds at 5,500 rpm from 30 seconds at 8,000 rpm using the same probe, PTA 35/4G. The final toner solution was stirred at room temperature for 2 hours, and then the temperature was increased to 50° C. overnight (16 hours).

EXAMPLE III

A carbon black, magnetite low melt, 120° C., encapsulated toner was prepared by the following procedure: Raven 5250 carbon black (Columbian), 10.0 grams, Ganex V216 (GAF), 2.0 grams, and methylene chloride ACS (Caledon), 50 milliliters, were ball milled together with ⅓ the volume of 5 millimeter diameter ball bearings for 48 hours yielding well dispersed 20 percent carbon black solution. Poly(ethylene succinate), (Scientific Polymer Products), 26.5 grams, was dissolved in methylene chloride ACS (Caledon), 120 milliliters, with the aid of a Burrell wrist action shaker model 75 overnight. This poly(ethylene succinate) was further dispersed with a Brinkmann PT 45/80 homogenizer and a PTA-20TS generator probe for 30 seconds at 10,000 rpm. To this polymeric solution was dispersed MO-8029 magnetite (Pfizer Corp.), 8.0 grams, and of the above dispersed 20 percent carbon black mixture, 10.0 grams, for 3 minutes at 10,000 rpm with the PTA-20TS probe. With the same probe, sebacoyl chloride (Aldrich), 5.7 grams, was homogenized into the pigmented polymer mixture for 30 seconds at 5,000 rpm. Using the PTA 35/4G probe, the resulting pigmented oil phase solution was homogenized into an aqueous solution consisting of a 0.75 percent polyvinylalcohol (Scientific Polymer Products, 88 percent hydrolyzed, molecular weight 96,000), 500 milliliters, 2-decanol (Aldrich), 0.5 milliliter, and $Na_2CO_2$ (Baker), 5.2 grams, for 20 seconds at 5,500 rpm. The formed solution was then transferred into a 2 liter beaker equipped with a mechanical stirrer and an oil bath under the beaker. An amine solution consisting of 1,6 hexanediamine (Aldrich), 1.0 gram, diethylenetriamine (Aldrich), 1.2 grams, and distilled water, 25 milliliters, was added dropwise to a vigorously stirring solution in the beaker over a 5 minute period. The reaction mixture was permitted to stir for 2 hours at room temperature, and during this time the interfacial polymerization to form a polyamide shell occurred. Following this, the solution was heated to 50° C. overnight to remove the residual methylene solvent chloride, and the reaction was allowed to cool to room temperature. After washing the toner particles 5 times by settling with a magnet and drawing off the supernatant, the particles were spray dried using a Yamato-Ohkawara spray dryer Model DL-41. The average particle size of the resulting toner particles was 13.4 microns with a GSD of 1.41 as determined using a Coulter Counter.

EXAMPLE IV

By repeating the procedure of Example III, similar low melt, encapsulated toners containing carbon black and magnetite were prepared with the exception that the dispersant Ganex V216 was changed to OLOA 1200 (Chevron), Pliolite OMS (Goodyear), or Shelflex 310 (Shell Chemicals). The average particle size of the resulting toner particles was 10.4 microns with a GSD of 1.50 determined using a Coulter Counter. The bulk density or packing density was about 0.35 gram per cubic centimeter for each toner composition.

EXAMPLE V

A black low melt, encapsulated toner was prepared by repeating the procedure of Example III with the following exceptions: chlorinated polyolefin CP343-1 (100 percent) (Eastman Chemicals), 26.5 grams, was substituted for poly(ethylene succinate) and the volume of solvent (methylene chloride, ACS, Caledon) to dissolve the polymer was increased to 150 milliliters from 120 milliliters. The final toner particles were analyzed with a Coulter Counter which determined that the average particle size was 11.7 microns with a GSD of 1.36. The bulk density was 0.28 gram per cubic centimeter.

EXAMPLE VI

A low melt, encapsulated black toner was prepared as follows: MO-8029 magnetite (Pfizer Corp), 9.0 grams, Raven 5250 carbon black (Columbian), 3.0 grams, Ganex V220 dispersant, (GAF), 0.4 gram, (3.3 percent by weight of pigment), and methylene chloride ACS (Caledon), 50 millilters, were ball milled together for 48 hours with ⅓ the volume of 5 millimeters diameter ball bearings to produce a well dispersed pigment solution. Into a 250 milliliter plastic bottle was dissolved chlorinated polyolefin CP343-1 (100 percent) (Eastman Chemicals), 29 grams, in methylene chloride, 150 milliliters, with the aid of a Burrell wrist action shaker model 75 overnight. The chlorinated polyolefin solution was further dispersed with a Brinkmann PT 45/80 homogenizer and a PTA-20TS generator probe for 30 seconds at 10,000 rpm. To this was added the dispersed black pigment slurry which first passed through a conical shaped metal screen collecting the ball bearings. The resulting mixture was homogenized for 3 minutes at 10,000 rpm with a PTA-20TS probe. Immediately after, sebacoyl chloride (Aldrich), 6.38 grams, was dispersed in the pigmented polymer solution for 30 seconds at 5,000 rpm. This oil phase was then dispersed with the PTA 35/4G probe for 20 seconds at 5,500 rpm into an aqueous solution of 0.75 percent polyvinylalcohol (Scientific Polymer Products, 88 percent hydrolyzed, molecular weight 96,000), 500 milliliters, 2-decanol (Aldrich), 0.5 milliliters, and $Na_2CO_3$ (Baker), 5.2 grams. The solution was transferred into a 2 liter beaker equipped with a mechanical stirrer, and an oil bath under the beaker. While stirring, a solution consisting of 1,6 hexanediamine (Aldrich), 1.25 grams, diethylenetriamine (Aldrich), 1.375 grams, and distilled water, 25 milliliters, was added dropwise over a 5 minute period. Stirring was continued for 2 hours at room temperature and during this time the interfacial polymerization reaction occurred to form a polyamide shell. After 2 hours, the temperature was increased to 65° C. for 16 hours to evaporate the dichloromethane. The resulting toner particles were then washed 5 times to remove excess stabilizer polyvinylalcohol with a Damon IEC B-204 centrifuge rotating at 10,000 rpm for 10 minutes. Prior to spray drying, the particles were screened through 425 and 250 micron sieves to remove large aggregates, and the inlet temperature of the spray dryer was 125° C. and the outlet temperature was 55° C. using the Yamato-Ohkawara spray dryer model DL-41. Thereafter, the toner particles, 86.1 percent yield after spray drying, were placed into a vacuum oven overnight at 57° C., and then screened through a 90 and 45 micron sieves. Subsequently, a flow agent Aerosil R972 (0.3 percent by weight) (Degussa Canada Ltd.) was mixed into the toner, and powder cloud images were formed and fixed in a xerographic imaging test fixture containing an amorphous selenium photoreceptor at about 700 psi and 150° C. with Viton fuser rolls. There resulted images of excellent resolution with no background deposits. The average particle size of the toner particles was 13.0 microns with a GSD of 1.51 as determined by a Coulter Counter. The bulk density of the toner was 0.204 gram per cubic centimeter.

EXAMPLE VII

A carbon black, magnetite encapsulated low melt toner, 120° C., was prepared similar to the procedure of Example III, and more specifically as follows: Regal® 330 carbon black (Cabot), 9.0 grams, MO-8029 magnetite (Pfizer Corp.), 27 grams, Ganex V220 dispersant (GAF), 1.8 grams, chlorinated polyolefin CP343-1 (Eastman Chemicals), 91.5 grams, methylene chloride ACS (Caledon), 225 milliliters, and 200, 5 millimeter diameter, ball bearings were added to a 500 milliliter plastic bottle which was ball milled for 48 hours. After ball milling, the core solution was transferred into a 1 liter plastic bottle after passing through a conical shaped metal screen which separated out the ball bearings. The mixture was mixed with a polytron for 3 minutes at 10,000 rpm with a PTA-20TS probe and a Brinkmann PT 45/80 homogenizer. Sebacoyl chloride (Aldrich), 12.5 grams, was added and homogenized at 5,000 rpm for 30 seconds with the same probe. This organic phase was added to the aqueous phase consisting of 0.75 percent polyvinylalcohol solution (Scientific Polymer Products, 88 percent hydrolyzed, molecular weight 96,000), 500 milliliters, and 2-decanol (Aldrich), 0.5 milliliter, and homogenized for 3 minutes at 10,000 rpm with the PTA-20TS probe. Homogenization was accomplished in a 2 liter metal beaker. Thereafter, the mixture was transferred into a 2 liter reaction kettle equipped with a mechanical stirrer and an oil bath under the reactor. While stirring at room temperature, an amine solution was added dropwise over a 5 to 10 minute period, which solution contained 1,6 hexanediamine (Aldrich), 5.0 grams, diethylenetriamine (Aldrich), 5.0 grams, distilled water, 50 milliliters, and $Na_2CO_3$ (Baker), 12.0 grams. After the inital 2 hours, the temperature was increased to 65° C. for 16 hours and the volume of the solution was increased to 1.5 liters with distilled water. During this time, the dichloromethane was partly evaporated. Subsequently the solution was allowed to cool to room temperature and was washed 5 times by settling with a magnet and decanting off the supernatant. The resulting toner particles were screened wet through a 425 and 250 micron sieves and then spray dried using a Yamato-Ohkawara spray dryer model DL-41 at an inlet temperature of 120° C. and an outlet tempeature of 55° C. Percent yield of toner after spray drying was 50.5 percent, and the average particle size of the toner particles as determined by a Coulter Counter was 21.5 microns with a GSD of 1.34. Also, the bulk density of the formed toner was measured as 0.462 gram per cubic centimeter.

EXAMPLE VIII

A similar carbon black, magnetite encapsulated low melt toner, 120° C., was prepared by repeating the procedure of Example VII with the exceptions that the organic (oil) phase was dispersed into the aqueous for 4 minutes at 10,000 rpm with the PTA-20TS probe instead of 3 minutes, and when the solution was heated for 16 hours at 65° C., the volume of the reactor vessel was increased to 1.5 liters with 0.5 percent polyvinylalcohol (Scientific Polymer Products) instead of distilled water. This procedure produced toner particles with an overall percent yield of 73.5 percent. The average toner particle size as determined by a Coulter Counter was 19.2 microns with a GSD of 1.40. The packing or bulk density of the toner prepared was 0.465 gram per cubic centimeter.

EXAMPLE IX

A similar carbon black, magnetite encapsulated low melt toner, 120° C., was prepared by repeating the procedure of Example VII with the following exceptions: (1) The toner composition consisted of a 25 percent shell and a 75 percent core instead of 15 percent shell and 85 percent core. As a result, chlorinated polyolefin CP343-1, 75 grams, was selected instead of 91.5 grams, sebacoyl chloride (Aldrich), 25.5 grams, was selected instead of 12.5 grams, 1,6 hexanediamine (Aldrich), 6.75 grams, was selected in place of 5.0 grams and diethylenetriamine (Aldrich), 5.25 grams, was selected in place of 5.0 grams. (2) The core materials were homogenized for 2 minutes at 10,000 rpm instead of 3 minutes. (3) The aqueous phase consisted of 0.75 percent polyvinylalcohol (Scientific Polymer Products), 600 milliliters, and 2-decanol instead of a 0.75 percent polyvinylalcohol, 500 milliliters and 2-decanol. (4) The oil phase was mixed with a polytron for 4 minutes at 10,000 rpm with the PTA 35/4G probe instead of 3 minutes at 10,000 rpm with the PTA-20TS probe. After spray drying, the final dry toner was screened through 150 and 90 micron sieves before particle size analysis was performed. The average particle size of the two screened toner fractions as determined by a Coulter Counter were: (1) for the 150 micron fraction, the particle size was 14.7 microns with GSD of 2.04, and (2) for the 90 micron fraction, the particle size was 12.7 microns with a GSD of 1.87.

EXAMPLE X

A similar carbon black, magnetite encapsulated low melt toner, 120° C., was prepared by repeating the procedure of Example VII but with the following changes. Chlorinated polyolefin CP343-1 was substituted with poly(alpha-methyl styrene) Resin 18-210 (Amoco), 100.65 grams, a pigment dispersant such as Ganex V220 (GAF) was not selected, and the quantity of methylene chloride used was 200 milliliters instead of 225 milliliters. With a PTA-20TS probe, the core materials were dispersed for 2 minutes at 10,000 rpm instead of 3 minutes at 10,000 rpm, and the amount of sebacoyl chloride (Aldrich) was increased to 17.0 grams from 12.5 grams. A total of 600 milliliters of 0.75 percent polyvinylalcohol solution was selected in place of 500 milliliters and the organic phase was dispersed into the aqueous phase with the PTA 35/4G probe for 2 minutes at 10,000 rpm instead of 3 minutes at 10,000 rpm with the PTA-20TS probe. The amine solution contained diethylenetriamine (Aldrich), 3.7 grams, 1,6 hexanediamine (Aldrich), 3.3 grams, $Na_2CO_3$ (Baker), 12.0 grams, and distilled water, 50 milliliters. The resulting toner solution was stirred at room temperature for 5 hours, then heated overnight at 40° C., and finally the temperature was increased to 70° C. for 3 hours the next day. After washing and spray drying, the toner particles were screened through 150, 90 and 45 micron sieves. The bulk density was 0.474 gram per cubic centimeter. After passing through the 45 micron sieve, the average particle size of the toner particles measured by the Coulter Counter was 8.2 microns with GSD of 1.56. The percent yield of toner product after spray drying was 66.6.

EXAMPLE XI

A carbon black, magnetite encapsulated low melt toner, 120° C., was prepared by repeating the procedure of Example X and substituting poly(alpha-methyl styrene) Resin 18-240 for Resin 18-210 (Amoco). The percent yield of toner particles after spray drying was 75.9 percent. Also, the average particle size of the toner particles that passes through a 45 micron sieve was 8.3 microns with a GSD of 1.40, and the bulk density was measured as 0.496 gram per cubic centimeter.

EXAMPLE XII

A black low melt, 115° C., encapsulated toner was prepared as follows: Eastman Hydrocarbon Resin H-100, 45 grams, Petrolite Ultraflex wax, 5 grams, natural black oxide magnetite MO-8029 (Pfizer Corp., NY), 11.5 grams, Regal® 330 carbon black (Cabot), 4.5 grams, and dichloromethane, 50 milliliters, were ball milled for 18 hours. This mixture with dichloromethane, 10 milliliters, and terephthaloyl chloride, 14 grams, was homogenized for 60 seconds with a Brinkmann homogenizer PTA-20-TS at 10,000 rpm. Thereafter, the resulting core material was dispersed into an aqueous solution containing 0.75 percent polyvinylalcohol (88 percent hydrolyzed (Scientific Polymer Products, Ontario, NY), 1,000 milliliters, and 2-decanol, 0.5 milliliter, (Aldrich) by a Brinkmann homogenizer PTA 35/4G for 60 seconds at 10,000 rpm. The reaction mixture was then transferred into a 2 liter reactor equipped with a mechanical stirrer. Diethylenetriamine, 8 grams, potassium carbonate, 17 grams, in 50 milliliters of water was added over a 2 minute period. Stirring was continued for 2 hours at room temperature during which time an interfacial polycondensation reaction occurred between the acid chloride and the amine. Dichloromethane was removed by heating at 70° C. overnight. Once the mixture was cooled to room temperature, the toner composition resulting was settled. The supernatant was removed and the toner was washed five times with 2 liters of water. Thereafter, the mixture resulting was diluted to 1 liter, and spray dried using a Yamato-Ohkawara spray dryer Model DL-41 at about 120° C. (inlet temperature) and about 55° C. (outlet temperature) to yield 60 grams of blac toner particles of average particle size of 12.0 microns with a geometric standard deviation of 1.3 as determined with a Coulter Counter.

EXAMPLE XIII

Following the procedure of Example XII, a similar low melt encapsulated toner containing carbon black and magnetite was prepared with the following exceptions: 10.5 grams of terephthaloyl chloride was used instead of 14.0 grams; a mixture of 3 grams of hexanediamine and 2 grams of diethylenetriamine was used instead of 8 grams of diethylenetriamine; and 13 grams of potassium carbonate was used instead of 17 grams. Yield of toner product was 60 grams, and the average particle size 11 microns with a geometric standard deviation of 1.3 as determined with a Coulter Counter.

EXAMPLE XIV

Following the procedure as, of Example XII, a similar low melt encapsulated toner containing magnetite and carbon black was prepared with the exception that: Isonate 143 L "Liquid MDI" (Upjohn), 6.9 grams, was used in place of terephthaloyl chloride, 14.0 grams, and bis(aminopropyl)piperazine (Aldrich), 4.8 grams, was selected in place of diethylenetriamine, 8.0 grams. The yield of encapsulated toner product was 47 grams, and the average particle size 8.8 microns with a geometric standard deviation of 1.38 as determined with a Coulter Counter.

EXAMPLE XV

Into a polyethylene bottle, 125 milliliters, was added 50 grams of Eastman Hydrocarbon Resin H-100, 5 grams of carbon black (Regal® 330), 50 milliliters of methylene chloride, and 200 grams of ball bearings. This mixture was ball milled for 16 hours to produce a well dispersed pigment solution. In a separate container was dissolved 3.8 grams of metaaminophenol and 2.8 grams of sodium hydroxide in 40 milliliters of water. The ball milled solution was transferred into a 150 milliliter container (without the ball bearings), the ball bearings washed with 10 milliliters of methylene chloride, and this amount was added to the carbon black solution. To this mixture was added 8.4 grams of sebacoyl chloride. The resulting mixture was homogenized with Brinkmann PT45/80 homogenizer equipped with a PT-10ST generator probe at 10,000 rpm for 1 minute. The homogenized mixture was then dispersed with a PTA 35/4G probe for 1 minute at 10,000 rpm into a 500 milliliter aqueous solution of 0.75 percent polyvinylalcohol (Scientific Polymer Products, 88 percent hydroxylated, molecular weight 96,000). Subsequently, the dispersion was transferred into a 2 liter reactor equipped with a mechanical stirrer and a heating bath under it. While stirring, the meta-aminophenol solution was added all at once. This mixture was stirred for 2 hours during which time an interfacial reaction occurred between the sebacoyl chloride and the meta-aminophenol to yeild a polyesteramide shell. The mixture was diluted to 1.5 liters, and was then heated to 65° C. for 12 hours to remove the methylene choride. Thereafter, the resulting material was cooled and washed 5 times with 2 liters of water. The washed particles were then spray dried using a Yamato-Ohkawara DL-41 spray dryer, inlet temperature 125° C., and outlet temperature of about 55° C. to yield 35 grams of encapsulated toner particles having an average size of 11.2 microns with a geometric standard deviation of 1.33 as determined with a Coulter Counter. There resulted a black toner containing as core polymers a hydrocarbon resin (Eastman H-100), about 74.4 percent by weight, carbon black, 7.5 percent by weight, and containing as shell a low melting polyesteramide, about 18.1 percent by weight.

EXAMPLE XVI

A black low melt, 140° C., encapsulated toner was prepared as follows: Into a polyethylene bottle, 500 milliliters, was added n-butyl methacrylate (obtained from Aldrich), 120.0 grams, carbon black (Regal® 330), 10.02 grams, a styrene-n-butylmethacrylate copolymer of glass transition temperature of about 55° C., 7.95 grams, and 2,2'-azo-bis-(2,4 dimethyl-valeronitrile) (Polysciences, Inc.), 0.4 gram. The resulting polymeric core solution was ball milled for 16 hours with about ⅓ by volume of 5 millimeter diameter ball bearings to produce a well dispersed pigment solution. In a separate bottle, there was dissolved in water, 150 milliliters, methyl hydroquinone, 22.61 grams, and sodium hydroxide, 16.02 grams. The ball milled solution was then transferred to a 500 milliliter polyethylene bottle (without the balls). To this mixture, 134.9 grams, was added 2,2'-azo-bis-isobutyronitrile (Polysciences, Inc.), 2.4 grams, 2,2'-azo-bis-(2,4 dimethyl-valeronitrile) (Polysciences, Inc.), 2.0 grams, and azelaic acid dichloride, 20.5 grams. The resulting solution was then placed in a cold water bath for 10 minutes, followed by dispersing with a Brinkmann PT45/80 homogenizer equipped with a PTA 35/4G generator probe for 30 seconds at 8,000 rpm into an aqueous solution (cooled with cold water to about 13° C.) of 0.7 percent polyvinylalcohol (Scientific Polymer Products, 88 percent hydroxylated, molecular weight 10,000), 500 milliliters, (1 liter beaker), benzyl triethylammonium chloride, 2.5 grams, and 2-decanol (Aldrich), 0.5 milliliter. Thereafter, the dispersion was transferred into a 2 liter reactor equipped with a mechanical stirrer, a reflux condenser, and a heating bath under it. While stirring, the methyl hydroquinone solution was added over a period of one minute. The dispersion was kept at room temperature for three hours after transfer to the reactor. During this time, an interfacial reaction occurred between the azelaic acid dichloride and the methylhydroquinone to yield a polyester shell. Subsequently, 2.5 grams of potassium iodide were added to the dispersion and it was heated to 60° C. for three and one-half hours after the pH was adjusted with a dilute solution of hydrochloric acid to a pH of 8 to 10. The temperature was increased from 60° C. to 80° C. over a period of about one-half hour and heating continued for ten hours. The resulting material was cooled slowly to room temperature, and then washed two times (the particles being settled by gravity) with a basic sodium hydroxide aqueous solution (pH=10). The water medium was then acidified (pH=3) with hydrochloric acid, and washing was affected two more times under acidic conditions. Subsequently, the particles were washed with distilled water to constant pH, and the washed particles were then spray dried with a Yamato-Ohkawara DL-41 spray dryer, inlet temperature of 130° C., and outlet temperature of about 55° C., to yield 93.5 grams of encapsulated toner particles having an average particle size of about 8.0 microns with a geometric standard deviation of 1.35 as determined with a Coulter Counter. There resulted a black toner containing as core, a mixture of poly(n-butyl methacrylate) and styrene-n-butyl methacrylate copolymer, about 75.4 percent by weight of which about 4.7 percent was the copolymer, carbon black, about 5.9 percent by weight, and containing as shell a polyester material, about 18.7 percent by weight.

Other modifications of the present invention may occur to those skilled in the art subsequent to a review of the present application, and these modifications are intended to be included within the scope of the present invention.

What is claimed is:

1. An encapsulated heat fusable toner composition with a melting temperature of from about 65° C. to about 140° C. comprised of a core containing a polymer selected from the group consisting of polyethylene succinate, polyhalogenated olefins, poly( alphaalkylstyrenes), rosin modified maleic resins, aliphatic hydrocarbon resins, poly(ε-caprolactones), and mixtures thereof; and pigment particles, where the core is encapsulated in a shell prepared by interfacial polymerization reactions.

2. A toner composition in accordance with claim 1 containing in the core a vinyl monomer.

3. A toner composition in accordance with claim 1 wherein the shell is selected from the group consisting of polycarbonates, polyurethanes, polyureas, polyacrylates, polyamides, polyesters, polycyanurates, polyesteramides, and mixtures thereof.

4. A toner composition in accordance with claim 1 wherein the pigment particles are carbon black.

5. A toner composition in accordance with claim 1 wherein the pigment particles are comprised of magnetites.

6. A toner composition in accordance with claim 1 wherein the pigment particles are comprised of a mixture of carbon black and magnetites.

7. A toner composition in accordance with claim 1 wherein the polymer is poly(ethylene succinate).

8. A toner composition in accordance with claim 1 wherein the polymer is a chlorinated polyolefin.

9. A toner composition in accordance with claim 1 wherein the polymer is an aliphatic hydrocarbon resin with a softening point of from about 90° to about 130° C.

10. A toner composition in accordance with claim 1 wherein the polymer is a poly(α-methylstyrene) with a weight average molecular weight of from about 500 to about 1,500 gram/mole, and a softening point of from about 90° to about 145° C.

11. A toner composition in accordance with claim 1 wherein the polymer is a rosin modified maleic resin, an Elvax resin, or a Unirez resin.

12. A toner composition in accordance with claim 1 wherein the core contains additive particles.

13. A toner composition in accordance with claim 12 wherein the additives are comprised of nigrosine.

14. A toner composition in accordance with claim 12 wherein the additives are comprised of release fluid components.

15. A toner composition in accordance with claim 14 wherein the release fluid components are selected from the group consisting of silicone oils, mineral oils, and waxes.

16. A toner composition in accordance with claim 1 wherein the optical density thereof is from about 1.2 to about 1.7.

17. A toner composition in accordance with claim 1 wherein the polymer is present in an amount of from about 50 to about 85 percent by weight.

18. A toner composition in accordance with claim 2 wherein insitu polymerized vinyl type monomers selected from the group consisting of polystyrenes, methacrylates, acrylates, polyolefins, and mixtures thereof are utilized.

19. A process for the preparation of the toner composition of claim 1 which comprises dispersing pigment particles and polymer selected from the group consisting of polyethylene succinate, polyhalogenated olefins, polyalkyl-alkylstyrenes, rosin modified maleic resin, aliphatic hydrocarbon resins, poly(ε-caprolactones), and mixtures thereof; and a halogenated aliphatic solvent; thereafter adding the formed mixture to a water surfactant solution while mixing thereby enabling the formation of toner particles; encapsulating the formed toner particles within a shell prepared by interfacial polymerization; and evaporating the solvent by heating, followed by washing and drying the resulting toner.

20. A process in accordance with claim 19 wherein mixing is accomplished for a period of from about 20 seconds to about 10 minutes.

21. A process in accordance with claim 19 wherein the solvent selected has a boiling point of from about 35° to about 70° C.

22. A process in accordance with claim 19 wherein the solvent is dichloromethane.

23. A process in accordance with claim 19 wherein the solvent is hexane.

24. A process in accordance with claim 19 wherein the toner formulated is subjected to spray drying.

25. A process in accordance with claim 19 wherein the toner formulated is subjected to freeze drying or fluidized bed drying.

26. A method of imaging which comprises forming a latent electrostatic image on a photoconductive imaging member; subsequently developing this image with the toner composition of claim 1; thereafter transferring the image to a suitable substrate; and permanently affixing the image thereto by applying heat to the transferred image.

27. A method of imaging which comprises forming a latent electrostatic image on a photoconductive imaging member; subsequently developing this image with the toner composition of claim 2; thereafter transferring the image to a suitable substrate; and permanently affixing the image thereto by applying heat to the transferred image.

28. A method of imaging which comprises forming a latent electrostatic image on a photoconductive imaging member; subsequently developing this image with the toner composition of claim 14; thereafter transferring the image to a suitable substrate; and permanently affixing the image thereto by applying heat to the transferred image.

29. A method of imaging which comprises forming a latent electrostatic image on a photoconductive imaging member; subsequently developing this image with the toner composition of claim 15; thereafter transferring the image to a suitable substrate; and permanently affixing the image thereto by applying heat to the transferred image.

30. A process in accordance with claim 19 wherein the solvent is replaced by a vinyl monomer which is polymerized insitu.

31. A toner composition in accordance with claim 1 wherein the polymer is a poly(ε-caprolactone).

* * * * *